United States Patent [19]

Johnston

[11] 4,033,544

[45] July 5, 1977

[54] WALL FORMING STRUCTURE FOR POURED CONCRETE WALLS

[75] Inventor: Ronald J. Johnston, Georgetown, Canada

[73] Assignee: Aluma Building Systems Incorporated, Downsview, Canada

[22] Filed: June 3, 1976

[21] Appl. No.: 692,598

[52] U.S. Cl. ..... 249/40; 52/738; 249/190; 249/219 W

[51] Int. Cl.[2] ..... E04G 17/06

[58] Field of Search ..... 52/699, 700, 720, 738; 249/18, 33, 40–46, 190–191, 213–214, 216–217, 219 R, 219 W

[56] References Cited

UNITED STATES PATENTS

| | | | |
|---|---|---|---|
| 3,043,408 | 7/1962 | Attwood | 52/738 |
| 3,899,152 | 8/1975 | Avery | 249/18 |
| 3,927,858 | 12/1975 | Underhill | 249/213 |
| 3,984,079 | 10/1976 | Gates | 249/217 |

*Primary Examiner*—Francis S. Husar
*Assistant Examiner*—John McQuade
*Attorney, Agent, or Firm*—Donald E. Hewson

[57] ABSTRACT

A wall forming structure is disclosed, where very large panels may be formed having sheathing placed against a plurality of studs which are, in turn, secured to at least a pair of strongbacks where the strongbacks comprise a pair of channel-shaped members in spaced back-to-back relationship. The panels are placed in opposed relationship to form a cavity into which concrete is placed to form a wall, and the panels may each be moved as a single unit — depending upon their overall size. Indeed, using suitable spacers, the entire wall form may be constructed away from the place where a wall is to be formed, and be lifted or moved into place using suitable handling equipment such as cranes. Each strongback comprises a pair of channel-shaped members where there is an outwardly facing T-shaped slot formed in each side wall of each channel, and a plurality of plates each having an opening through its thickness is secured to each pair of channel-shaped members at each place where a tie will extend between the panels. Generally, the channel-shaped members of the strongback and the studs which are secured to the strongbacks and to which the sheathing is secured, are extruded aluminum.

10 Claims, 7 Drawing Figures

WALL FORMING STRUCTURE FOR POURED CONCRETE WALLS

FIELD OF THE INVENTION

This invention relates to wall forming structures which are intended for use during the construction of poured concrete walls, and in particular the invention relates to an assembly of sheathing, studs and a strongback which provides a novel panel for concrete wall forming which may be moved in very large sizes. The invention provides strongbacks where a pair of channel-shaped members each having outwardly facing T-shaped slots formed in their side walls may be used; and use of the special strongbacks permits assembly of the panels without the necessity of drilling connection holes, either before assembly or in the field.

BACKGROUND OF THE INVENTION

It has been known for many years to pour concrete walls by placing panels in an upright fashion and spaced apart, and to place liquid concrete between them. Such concrete walls have, for example, been used as basement walls for homes. However, very often, interior load bearing walls have been formed of the more usual concrete block placed on footings in the usual manner. More recently, however, there has been considerable emphasis on the use of poured concrete in the construction of large — usually high-rise — buildings such as apartment buildings. Such construction has very often employed the placement of poured concrete floors and formed columns or block or brick walls. More recently, however, it has been felt desirable to pour the concrete walls as well as the floors, and this has necessitated the development of concrete forming structures which are particularly intended for use during the formation of concrete walls as they are being poured and are setting.

Because of the different problems which are encountered — particularly the problems of developing and maintaining concrete forming structures having entirely different load bearing requirements and characteristics — there has very often been a separate contracting arrangement for the construction of high-rise buildings in respect of the horizontal forming (the floors) and the vertical forming (the walls).

There has, however, developed a system or approach to the construction of large buildings using poured concrete techniques whereby the concrete forming structures — the forms — are "flown" or placed in position using overhead cranes which may either be of the self climbing or mobile variety. This has been made particularly possible due to the development of concrete forming structures of the sort taught in Peter J. Avery Canadian Pat. No. 941,138 issued Feb. 5, 1974, wherein horizontal panels are carried and secured to top-hat beams of extruded aluminum, which in turn are secured through bolts placed in bolt slots within the beams so that the beams are secured to trusses, also formed of extruded aluminum. It has also been desirable to fly wall forms in large panels, or indeed as completed wall forms where the two spaced and opposed panels are moved as a unit. Previously, such as referred to in Peter J. Avery U.S. Pat. No. 3,899,152 issued Aug. 12, 1975, wall panels were devised using beams of the sort referred to in that patent and using steel channel members as the supporting and strengthening structure. For a number of reasons, particularly strength per unit weight and the number of ties required it was felt desirable to eliminate the use of steel channel members and to replace them with extruded aluminum members if possible. More especially, however, it was also felt desirable to develop strongback members for use in wall forming structures such that the studs — to which the sheathing, which comprises the face against which the concrete is formed, is secured — may be secured or attached to the strongbacks at any position without the necessity for drilling holes or special placements, and merely by using clamping members secured to the studs. This is particularly possible when the studs are top-hat beams of the sort referred to in Peter J. Avery Canadian Pat. No. 990,481 issued June 8, 1976 or the equivalent U.S. Pat. No. 3,899,152 issued Aug. 12, 1975, each being assigned to a common assignee herewith. In particular, it was felt to be most desirable to eliminate the necessity at any time to place holes, either in the shop or in the field, through the strongback members for purposes of attachment of the studs to the strongbacks, because the placement and machining of the holes is expensive, they reduce the strength of the strongbacks, and they are limiting as to the spacing which may then be permitted for the studs. At the same time, it was also felt desirable to provide strongback members such that additional or accessory attachments such as catwalk brackets, wall plumbing or wall bracing attachments, and the like might be secured to the strongbacks; as well as to provide for placement through the cavity into which the liquid concrete would be placed of as few tie members as possible but with the adaptability to place those tie members at any desired location and in such a manner that the forces exerted by the tie members as they take up the liquid pressure of freshly poured concrete would be transmitted to the strongback members without localized failure or undue local stresses being caused in the material of the strongback members.

Thus, this invention provides a wall forming structure which is intended for use during the construction of poured concrete walls, where the wall forming structure comprises a pair of opposed panels which are spaced apart so as to provide a cavity into which fluid concrete is placed so as to form the wall, and where each panel comprises substantially planar sheathing secured to a plurality of studs which are placed substantially parallel one to another. The studs are secured to at least a pair of strongbacks which are placed perpendicularly to the studs, and by this arrangement the panels are thereby capable of being moved as an integral unit. A plurality of ties extends through or across the cavity and through the sheathing from a strongback of one of the opposed panels to a strongback of the other opposed panel. In the wall forming structure of the present invention, each strongback comprises a pair of channel-shaped members which are placed in spaced back-to-back relationship; and each channel-shaped member has a pair of side walls and a base, an outwardly facing T-shaped slot suitable for receiving the head of a bolt in each side wall near the base, and an inwardly facing flange at the end of each side wall remote from the base. A plurality of plates each having an opening through its thickness is secured to each pair of channel-shaped members — i.e., to each strongback — by bolts placed in the T-shaped slots in the side wall of each of the channel-shaped members on the side thereof remote from the sheathing, with the openings in the plates being positioned between the respective channel-shaped members so that a tie may pass between the opposed bases of the pair of channel-shaped members and extend through the respective opening in the respective plate.

For purposes of this specification, as will be noted hereafter, it is assumed that either the studs or the strongback members may be placed in either a horizontal or vertical orientation. The sheathing is secured to the studs, and the studs are secured to the strongbacks which are outside the studs with respect to the cavity into which the liquid concrete is placed. Historically, when concrete wall forming structures were comprised entirely of wooden structural members, a plurality of vertical studs on very close centres were placed behind the sheathing, and horizontal waler members were thereafter placed behind the vertical studs. By so doing, the stud spacing could be constant. However, as will appear hereafter, it is more general, particularly according to this invention, to use vertical strongback members behind horizontal studs which are not equally spaced from top to bottom.

In general, it is the contemplation of this invention that each of the studs would comprise a top-hat beam which is generally of the sort referred to above. Each such top-hat beam has a top-hat channel with a pair of outwardly extending flanges and an insert in said channel in which driveable fasteners may be driven so as to secure the sheathing to the studs. A web portion extends away from the top-hat channel, and a base portion having a T-shaped slot suitable for receiving the head of a bolt is formed in the base portion of the top-hat beam, with a pair of base flanges extending outwardly from the T-shaped slot. The studs may thus be secured to the strongbacks — i.e., to the channel-shaped members which form the strongbacks — by clamps which are secured to the studs by bolts having their heads placed in the T-shaped bolt slots of the top-hat beams, where the clamps have a hook-like end which is adated to fit over the inwardly facing flanges of the side walls of the channel-shaped members which comprise the strongbacks at the sides thereof which are contiguous to the studs.

It is also contemplated that, in general, the studs and strongbacks would all be extruded aluminum members, which provides the best combination of strength per unit weight, so that very large panels may be flown at one time.

By using the top-hat beam referred to above, a common component of wall forming or slab forming structures is used, especially on job-sites where concrete forming structures of the sort taught in the Avery patents referred to above are used. It is also anticipated that, by using a splice member which is referred to hereafter, the strongback members may be extended to any desired length. Where the splice members are to be used, holes are placed in the base of the channel-shaped member and in the base of the splice member, according to construction industry standards, and the strength of the strongback member at that point is thereby still within acceptable limits. In any event, those are the only holes contemplated to be drilled in any of the studs or strongback members, and are used only to extend the length of the strongback members and not to secure other members such as studs to the strongback members.

Plates were referred to above, and are secured to the strongbacks in such a manner that a single plate is secured to each of the pair of back-to-back channel-shaped members which form the strongback so that the ties which take up the outward pressure of the newly placed liquid concrete are secured in place by passing between the back-to-back channel members and through a hole which is in the plate and through the thickness thereof, for that purpose. Sometimes, however, it is desired to use ties having different diameters, depending upon the thickness and/or height of the wall; and for that purpose, the plates are normally provided having a large diameter hole so as to accommodate the largest contemplated tie, and with an insert plate — in this case, usually steel — which may be placed over the hole and which in turn has a smaller hole formed therein.

It has also been a problem, in the field, of preventing slippage of one or another of a pair of back-to-back steel channels as they may be being assembled, or indeed flown. This invention contemplates the use of a "shoe" which is generally L-shaped and adapted to have one leg of the L extend across the ends of the channel-shaped members. The shoe is also adapted to be secured to the channel-shaped members of the strongbacks by bolts having their heads placed in the T-shaped slots which are formed in the strongback channel-shaped members.

BRIEF SUMMARY OF THE INVENTION

It is a purpose of this invention to provide a concrete forming structure for forming poured concrete walls, where the panels of the concrete forming structure comprise sheathing secured to studs which are, in turn, secured to strongbacks and which may be moved with large panels being handled as a unitary structure.

A further object of this invention is to provide a concrete forming structure for poured concrete walls having a unique strongback assembly which is such that studs and other accessories may be secured to it and any place without the necessity for holes having to be drilled or formed in the strongback.

A feature of this invention is that the studs — to which the sheathing is secured — may be placed either horizontally or vertically, and the strongbacks are secured to the studs generally perpendicularly related thereto. Thus, if the studs are horizontal — a usual circumstance according to the present invention — the strongbacks are vertical, and fewer strongbacks are needed.

BRIEF DESCRIPTION OF THE DRAWINGS

These and other features and objects of this invention are described in greater detail hereafter, is association with the accompanying drawings, in which.

DESCRIPTION OF THE PREFERRED EMBODIMENTS

Figure 2:
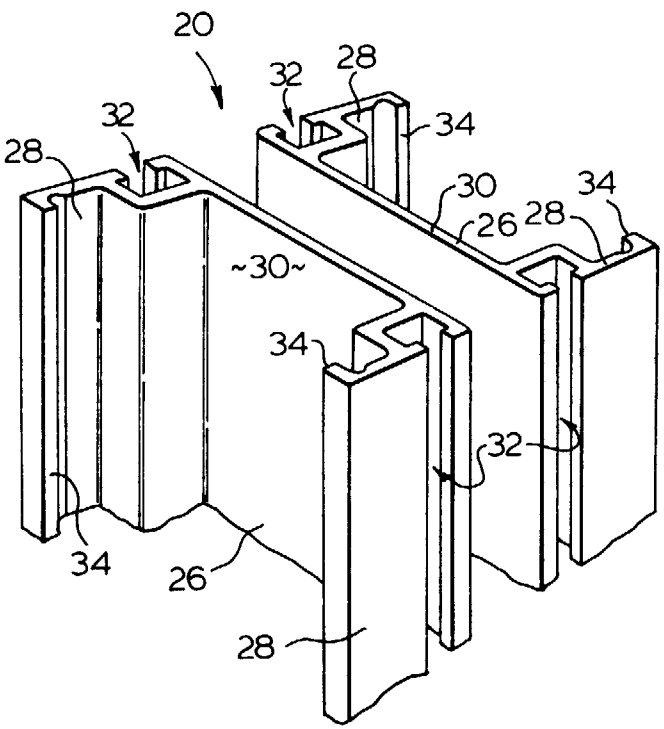
FIG. 2 is a perspective view showing details of the strongback members according to this invention.

As noted above, this invention provides a wall forming structure generally designated 10 which is used during the construction of poured concrete walls, and the wall forming structure generally comprises a pair of opposed panels 12 which are spaced apart so as to provide a cavity 14 into which fluid concrete is placed so as to form a wall. Each of the panels 12 comprises substantially planar sheathing 16 which is secured to a plurality of studs 18. The studs 18 are generally placed parallel one to another; and the studs 18 are secured to at least a pair of strongbacks, each of which is designated generally at 20. As discussed in greater detail hereafter, the studs and strongback are arranged perpendicularly one to the other. A plurality of ties 22 extends across the cavity 14 — or, alternatively, as a yoke as shown at tie 23 in FIG. 4.

Each strongback 20 comprises a pair of channel-shaped members 26 which are placed in spaced back-to-back relationship. Each of the channel-shaped members 26 has a pair of side walls 28 and a base 30. There is an outwardly facing T-shaped slot 32 formed in each side wall 28 near the base 30, and each T-shaped slot 32 is suitable for receiving the head of a bolt as discussed in greater detail hereafter. An inwardly facing flange 34 — inwardly with respect to the channel-shape of each of the members 26 — is formed at the end of each of the side walls 28 which is remote from the base 30. It will be noted hereafter that the inwardly facing flanges 34 serve the purpose of securing studs 18 to the strongbacks 20 by securing the studs 18 to the channel-shaped members 26.

A plurality of plates 36 are secured to the strongbacks 20 in the following manner. In the top and bottom edges of each of the plates 36 there are pairs of slots 38 through which pass bolts 40 whose heads are placed in the respective T-shaped slot 32 of the respective channel-shaped member 26, and the plates 36 are secured to the channel-shaped members 26 by nuts 42 which engage the bolts 40. The ties 22 are therefore secured to the panels 12 and adapted to transfer force taken up by the ties when fluid concrete is first placed in the cavity 14. The ties 22 have nuts 44 placed over them so as to assure the force transmitting relationship between each tie 22 and the respective strongbacks 20 at each end of the tie 22. It will be noted that each of the ties 22 passes between the bases 30 of the respective back-to-back channel-shaped members 26 of the strongbacks 20, so that forces transferred by the tie 22 are taken by each of the members 26.

Each of the studs 18 is secured to the channel-shaped members 26 by clamps 46 which have a hook-like end 48 which is adapted to fit over the flanges 34 of each of the channel-shaped members 26. The studs 18 are top-hat beams having a top-hat channel 50 with an insert 52 placed in the channel 50 and being such that driveable fasteners such as nails may be driven into the insert 52 — usually wood — so as to secure the sheathing 16 to the studs 18. Of course, the inserts 52 are secured in the top-hat channels 50, usually by driveable fastening means 54 which are driven through the side wall of the top-hat channel 50 into the insert 52. The studs 18 each have a web portion 56 which extends away from the top-hat channel 50, and a base portion having a T-shaped slot 58 and a pair of base flanges 60 which extend outwardly away from the T-shaped slot 58. The studs 18 are therefore secured to the strongbacks 20 by bolts 62 having their heads placed in the T-shaped slots 58 and having nuts 64 threaded on them. Obviously the spacing between studs 18 may be adjusted to any desired spacing without the necessity for pre-drilling or otherwise pre-arranging the strongbacks 20 as will be noted hereafter, when the studs are horizontally oriented, they are more closely spaced at the bottom of the wall form than at the top of the wall form. On the other hand, if the studs are vertically oriented, they may be evenly spaced; but in that case, the spacing between them must be such as to take up the force exerted against the form at the bottom thereof by the fluid concrete when it is first placed.

Figure 3:
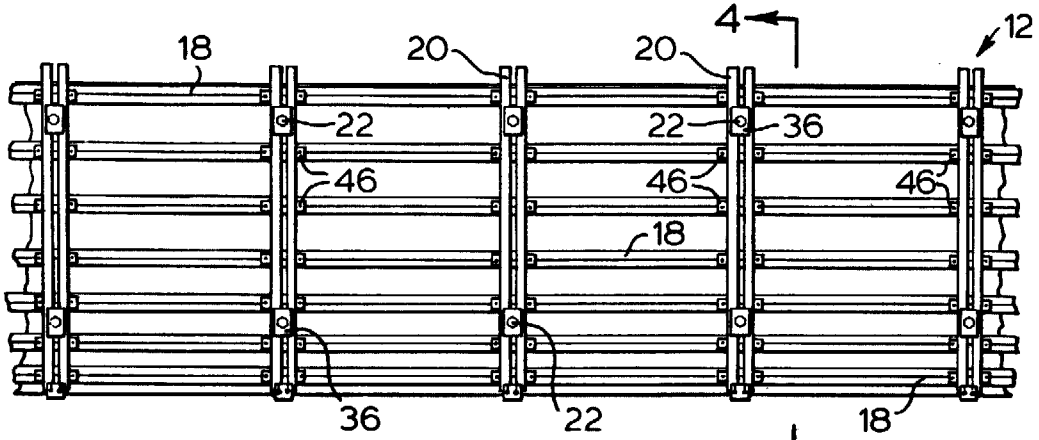

It will be noted, for example, from FIG. 3 that the spacing between the horizontally disposed studs 18 becomes less towards the bottom of the wall form, whereas the spacing between the vertically disposed strongbacks 20 is essentially equal. This is, of course, because of the increase in outwardly exerted pressure by the fluid concrete as it is placed in the cavity 14, before it sets. The decrease in spacing between each pair of studs 18, progressing downwards, may therefore be essentially linear and is readily calculated from the knowledge of the outward forces which will be exerted by the weight of the fluid concrete when first placed. Indeed, concrete pouring rates can also be considered, so as to utilize the most efficient and economical combination of materials and man hours.

Likewise, as noted above, if the studs 18 were to be placed vertically with the strongbacks horizontally, the spacing between the studs would have to be sufficiently close that they could withstand the forces exerted outwardly by the weight of fluid concrete at the very bottom of the wall form, and thus the wall form would be "over-designed" at the top for any particular assembly.

Very often, when the wall forming structure is assembled and the ties put in place, the plates 36 are assembled with an additional plate 66 secured to the front face of the plate 36. This is accomplished by forming the plate 36 so that it has a shallow channel 68 across its width, with inwardly extending flanges 70 in the upper portions of the sides of the channel 68. The second plate 66, which usually has a smaller hole through its thickness than the hole which is through the thickness of the plate 36, is secured in the channel with its respective edges — in this case, the upper and lower edges — being covered by the inwardly extending flanges 70. In general, so as to assure force distribution and so as to guard against localized stress exceeding permitted limits, the second insert plate 66 is steel.

Figure 1:
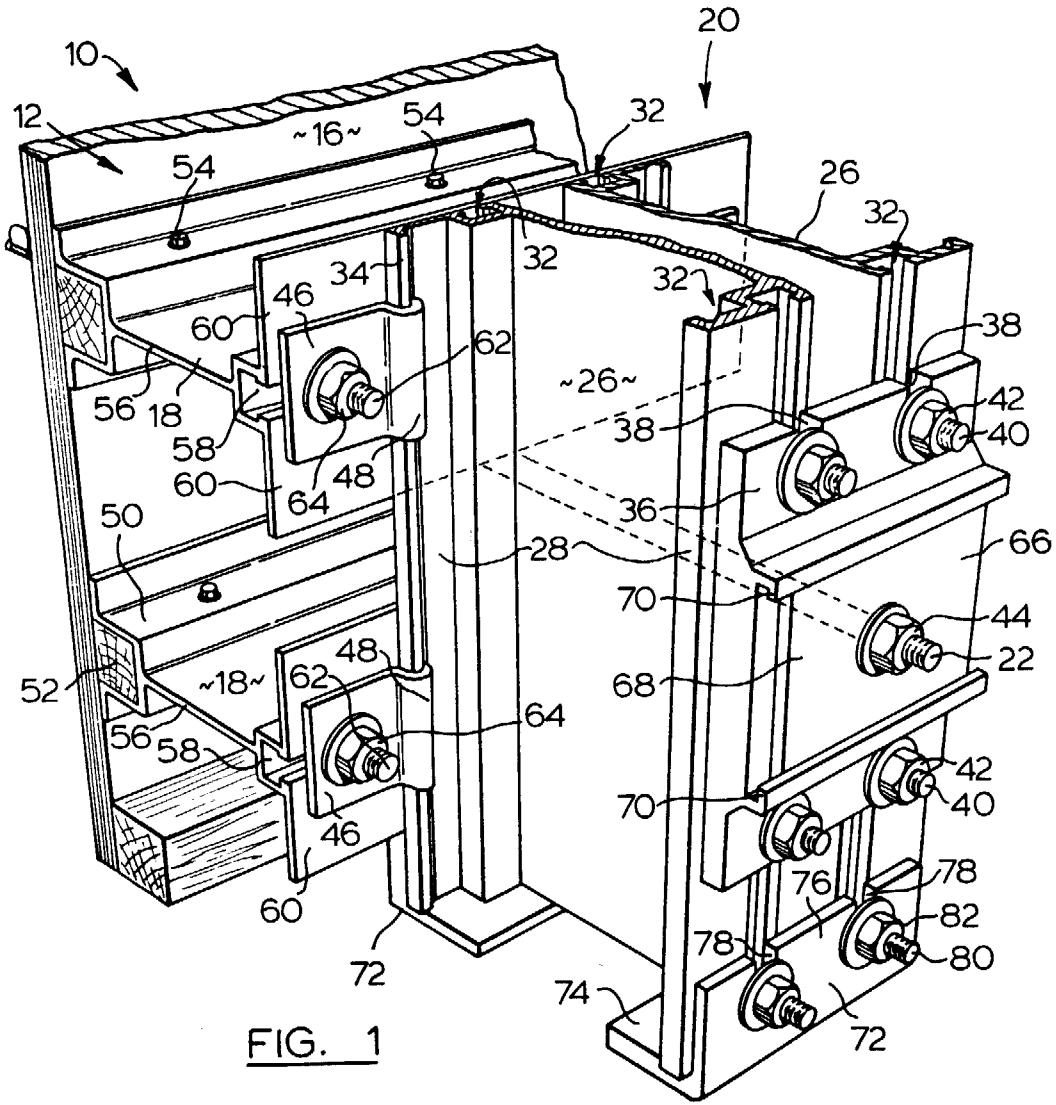
FIG. 1 is a perspective view showing an assembly of the major components which comprise a panel for a wall forming structure according to this invention.
Figure 7:
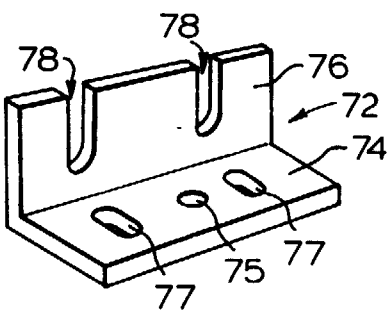
FIG. 7 is a perspective view of an L-shaped shoe.

It has been noted that the strongbacks 20 may be assembled with an L-shaped shoe 72 secured across the faces of the channel-shaped members 26 which are remoted from the sheathing 16. The L-shaped shoe 72 has a leg 74 which is oriented perpendicularly to the outer faces of the channel-shaped members 26, and a leg 76 having slots 78 formed therein so that the front shoe 72 is secured to the front faces of the channel-shaped members 26 by bolts 80 having their heads in the respective T-shaped slots 32 and having nuts 82 threaded on them. The shoes 72 protect the lower ends of vertically oriented strongbacks 20, and may guard against slipping or relative movement of one of the channel-shaped members 26 with respect to the other member in a strongback 20, especially during assembly or lifting. The front shoe 72 may, of course, be oriented and secured to the strongbacks 20 with the leg 74 extending outwardly in a direction away from the sheathing 16, in which case other accessory attachments may be secured to the shoe 72. Reference to FIG. 7 will show that, in a preferred embodiment, the L-shaped shoe 72 has a centrally located hole 72 in leg 74, and a pair of holes 77 in line with the slots 78 — and also spaced so as to co-operate with slots 32 of a strongback. The thickness of leg 74 is greater than that of leg 76 in the preferred embodiment. Thus, as shown in FIG. 1, when the front shoe 72 is placed with leg 74 beneath the lower ends of the channel-shaped members 26 of a strongback and the back shoe 72 is placed with leg 76 beneath the lower ends of the strongback members, the underside of the rear shoe leg 76 is higher than the underside of the front shoe leg 74. If the lowermost horizontally oriented stud 18 is butted against the end of the leg 74 of the rear shoe 72 — i.e., it is contiguous thereto — and the rear shoe 72 is secured to the strongback 20 by bolts placed in the slots 32 and passed through holes 77, the possibility of the lowermost stud 18 — and therefore of all of the other studs which are also secured to the sheathing 16 — slippage during lifting of the panel 12 is substantially precluded.

Because of the T-shaped slots 32 formed in the faces of the channel-shaped member 26, accessory attachments may be secured by bolts having their heads placed in the slots 32 at any desired location.

Figure 5:
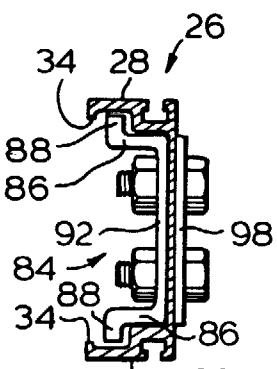
FIGS. 5 and 6 are end and side views, respectively, of a splice member adapted to extend the length of the strongback members according to this invention.
Figure 6:
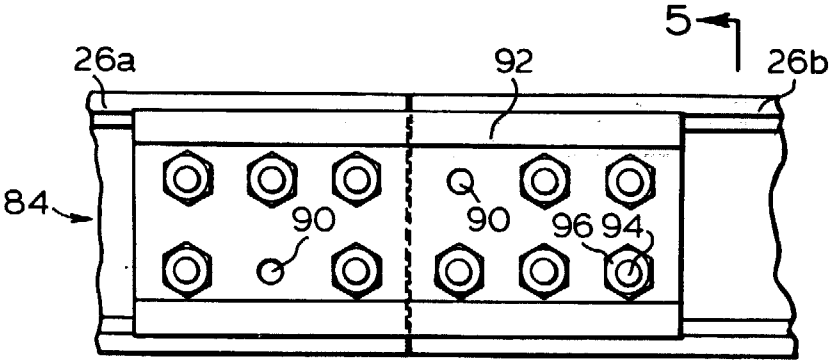

It may be that it is desirable either to extend the height of a wall form, or if the strongbacks are placed horizontally to extend the length of the wall form using splice members on the channel-shaped members 26. In FIGS. 5 and 6 there is shown such a combination, where the splice member 84 is a generally U-shaped member having side walls 86 and outwardly extending flanges 88 at the outer ends of the side walls 86. A plurality of spaced holes 90 is formed in the base 92 of the splice member 84, and a corresponding plurality of holes are formed at the ends of the channel-shaped members 26. In FIG. 6, two channel-shaped members **26*a* and 26*b* are shown in end-to-end relationship, and they are secured or spliced using the splice member 84 by having bolts 94 with nuts 96 threaded on them passed through the channel-shaped members 26*a* and 26*b* and the respective holes 90 in the splice member 84. For added strength, a further flat plate 98 may be secured behind the base 30 of the respective channel-shaped member 26**, with correspondingly spaced holes formed therein.

It will be noted that the outwardly extending flanges 88 fit between the side walls 28 of the respective channel-shaped member 26 at a place other than the posed inwardly facing flanges 34. As viewed in FIG. 5, the outwardly extending flanges 88 of the splice member 84 are behind the inwardly extending flanges 34 of the channel-shaped member 26.

Figure 4:
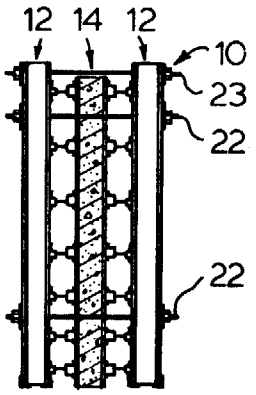
FIGS. 3 and 4 are side and end views, respectively, of a typical wall forming structure according to this invention.

Using an assembly of a concrete forming structure for poured concrete walls according to this invention, such as illustrated in FIGS. 3 and 4, it is not uncommon for entire panels to be assembled having a height of 9 or 10 feet and a length of 25 or 30 feet, where the panel — or indeed, in some cases, the pair of panels as an entire wall forming structure — may be moved or "flown" as a unitary structure at one time. The man hour cost of placing the wall forming structure in its working position is, therefore, considerably reduced over the former methods of placing the sheathing, studs and walers or strongbacks individually at each working position. Indeed, using an assembly according to this invention, and considering the wall form layout illustrated in FIGS. 3 and 4 where the strongbacks are 8.5 feet high and are placed at 6 foot centres, the weight of the assembled panel is less than 8.5 pounds per sq. ft. of sheathing — i.e., per sq. ft. of wall forming area. For such an arrangement, only two ties 22 are required for each pair of strongbacks 20, placed one on either side of the cavity with the ties extending across or through the cavity. This greatly reduces the number of ties that are used; and having regard to both sides of the formed wall, and the fact that the upper tie may be a yoke 23, up to 96 contact square feet of poured wall surface per tie may be realized.

It is also possible, using the channel members 26 according to the present invention, to construct inside or outside corners, utilizing the T-shaped bolt slots 32. Similarly, wall forming structures according to the present invention may be adapted for slip forming purposes; and, of course, for special shapes such as radi-used tank walls, etc., special studs can be prepared and secured to the strongbacks 20 in the manner discussed above.

In general, the T-shaped slots 32 which are next adjacent the base flanges 60 of the studs 18 are not utilized, the attachment being by way of the clamps 46. However, the channel-shaped members 36 are made symmetrical so that they do not need to be extruded in left-space and right-hand versions.

Other advantages of the use of wall forming structures for poured concrete walls according to the present invention will, of course, become evident to persons skilled in that art, and other amendments and modifications to the concrete forming structure for poured concrete walls according to this invention may be made without departing from the spirit and scope of the appended claims.

I claim:

1. A wall forming structure intended for use during the construction of poured concrete walls, comprising a pair of opposed panels spaced apart so as to provide a cavity into which fluid concrete is placed to form a wall; where each of said panels comprises substantially planar sheathing secured to a plurality of studs placed substantially parallel one to another, and said studs are secured to at least a pair of strongbacks placed perpendicularly to said studs, each of said panels being thereby capable of being moved as an integral unit; and where a plurality of ties extend across said cavity and through said sheathing from a strongback of one panel to a strongback of the other panel; the improvement where:

each strongback comprises a pair of channel-shaped members placed in spaced back-to-back relationship; where each channel-shaped member has a pair of side walls and a base, an outwardly facing T-shaped slot suitable for receiving the head of a bolt in each side wall near said base, and an inwardly facing flange at the end of each side wall remote from said base;

and a plurality of plates each having an opening through its thickness secured to each said pair of channel-shaped members by bolts placed in the outwardly facing T-shaped slot in the side wall of each of said channel-shaped members which is remote from said sheathing, the openings in said plates being positioned between the respective channel-shaped members so that a tie may pass between the opposed bases of said pair of channel-shaped members and extend through the respective opening.

2. The combination of claim 1 where said studs each comprise a top-hat beam having a top-hat channel with a pair of outwardly extending flanges and an insert in said channel into which driveable fasteners may be driven to secure said sheathing to said studs, a web portion extending away from said top-hat channel, and a base portion having a T-shaped slot suitable for receiving the head of a bolt formed therein and a pair of base flanges extending outwardly from said T-shaped slot;

said studs being secured to said strongbacks by clamps secured to said studs by bolts having their heads placed in the T-shaped slots thereof, said clamps having a hook-like end adapted to fit over the inwardly facing flange of the side wall of each of said channel-shaped members which is contiguous to said studs.

3. The combination of claim 1 where each of said plurality of plates is formed with a shallow channel across its width on the front face thereof, with inwardly extending flanges in the upper portion of the sides of said channel; and a second plate secured in said channel with its respective edges being covered by said inwardly extending flanges and having a smaller hole therein than the hole in the first plate, said smaller hole being placed over the hole in said first plate.

4. The combination of claim 1 further comprising an L-shaped shoe across the side walls of each said pair of channel-shaped members which are remote from said studs and sheathing, where a first leg of said L-shaped shoe is oriented perpendicularly to said side walls of each said pair of channel-shaped members.

5. The combination of claim 1 where each said strongback includes pairs of channel-shaped members placed end-to-end, where a splice member is placed at the ends and in the channel of each end-to-end pair of channel-shaped members, and said splice member comprises a generally U-shaped member with side walls and having outwardly extending flanges at the outer ends of its side walls; where said splice member has a plurality of spaced holes formed therein and each said channel-shaped member has a plurality of correspondingly spaced holes formed therein so that said channel-shaped members and said splice member may be connected by bolts passed through said holes, and where said outwardly extending flanges of said splice member are adapted to fit between said side walls of said channel-shaped members at a place other than between the opposed inwardly facing flanges of each such channel-shaped member.

6. The combination of claim 4 where said first leg of said L-shaped shoe extends inwardly towards said sheathng at an end of each said pair of channel-shaped members.

7. The combination of claim 1 where at least said channel-shaped members are extruded aluminum.

8. The combination of claim 5 further comprising a flat plate member on the faces of the bases of each end-to-end pair of channel-shaped members, said flat plate member having a plurality of spaced holes formed therein corresponding to the holes formed in the respective splice member.

9. The combination of claim 2 where said channel-shaped members and said top-hat beams are extruded aluminum.

10. The combination of claim 4 further comprising a second L-shaped shoe secured across the side walls of each said pair of channel-shaped members which are nearest to said studs and sheathing, where said first leg of the first-mentioned L-shaped shoe extends beneath the lower ends of vertically oriented strongbacks, and where a second leg of said second L-shaped shoe having a thickness less than the thickness of said first leg of said first-mentioned L-shaped shoe also extends beneath said lower ends of said vertically oriented strongbacks; and where the lowest stud is contiguous at its lower edge to the end of the first leg of each said second L-shaped shoe.

* * * * *